US006917266B2

(12) United States Patent
Mack

(10) Patent No.: US 6,917,266 B2
(45) Date of Patent: Jul. 12, 2005

(54) MICROWAVE WAVEGUIDE

(76) Inventor: Paul Mack, 25 Shipley Crescent, Stittsville, Ontario (CA), K2S 1R2

( * ) Notice: Subject to any disclaimer, the term of this patent is extended or adjusted under 35 U.S.C. 154(b) by 16 days.

(21) Appl. No.: 10/232,590

(22) Filed: Sep. 3, 2002

(65) Prior Publication Data

US 2003/0020570 A1 Jan. 30, 2003

Related U.S. Application Data

(63) Continuation-in-part of application No. 09/685,213, filed on Oct. 11, 2000, now Pat. No. 6,476,696.

(51) Int. Cl.[7] ..... H01P 1/00

(52) U.S. Cl. ..... 333/248; 333/208; 333/239; 333/157

(58) Field of Search ..... 333/248, 208, 333/212, 251, 239, 157

(56) References Cited

U.S. PATENT DOCUMENTS

| | | | | | |
|---|---|---|---|---|---|
| 2,772,400 | A | | 11/1956 | Simmons | |
| 3,046,503 | A | | 7/1962 | Cohn | |
| 3,758,882 | A | * | 9/1973 | Morz | 333/21 A |
| 3,824,504 | A | * | 7/1974 | Parris | 333/208 |
| 4,672,334 | A | * | 6/1987 | Saad | 333/21 A |
| 6,169,466 | B1 | * | 1/2001 | Goulouev | 333/210 |
| 6,657,520 | B2 | * | 12/2003 | Mack et al. | 333/208 |

* cited by examiner

*Primary Examiner*—Robert Pascal
*Assistant Examiner*—Kimberly Glenn
(74) *Attorney, Agent, or Firm*—Freedman & Associates

(57) ABSTRACT

A microwave component has a cavity including a plurality of geometrically shaped elements therein wherein the shape profile and position of the elements in relation to the cavity act to define the guiding properties of the cavity and therefore to define operational characteristics of the component.

35 Claims, 12 Drawing Sheets

(EXPLODED VIEW)

(CROSS SECTION THRU COMPONENT)

(EXPLODED VIEW)

(CROSS SECTION THRU COMPONENT)

(SECTION THROUGH ELEMENT)

(SECTION A-A)

(SECTION B-B)

(SECTION THROUGH MICROWAVE COMPONENT)

(SECTION A-A)

(EXPLODED VIEW)

(CROSS SECTION THRU COMPONENT)

(EXPLODED VIEW)

(CROSS SECTION THRU COMPONENT)

(SECTION THROUGH COMPONENT)

(EXPLODED VIEW)

(EXPLODED VIEW)

MICROWAVE WAVEGUIDE

This application is a continuation-in-part of U.S. patent application Ser. No. 09/685,213 filed Oct. 11, 2000, now U.S. Pat. No. 6,476,696.

FIELD OF THE INVENTION

This invention relates to the design of microwave components and, in particular, to designs which incorporate geometrically-shaped elements within a waveguide structure.

BACKGROUND OF THE INVENTION

Present waveguide design techniques rely on the fields generated by physical attributes such as internal contours and slot arrays but these physical attributes are difficult to control by reason of limiting manufacturing tolerances, operational variations, environmental changes and the target performance requirements. As a result, the present devices have associated with them undesirable performance losses and/or costs.

SUMMARY OF THE INVENTION

In accordance with the invention there is provided a microwave component comprising: a waveguide channel; a plurality of geometrically-shaped elements producing a field response and having known dimensions within a tolerance, the tolerance defining a random variation from each of the known dimensions and positioned within the channel in spaced relationship one to another, wherein the number, dimensions and spacing of said elements determine performance characteristics of the microwave waveguide, characterized in that if the random variation from each of the known dimensions is a fixed same maximum variation having a fixed same polarity for each of the plurality of geometrically shaped elements, the performance characteristics of the microwave waveguide is a first performance characteristic and if the random variation from each of the known dimensions is a fixed same maximum variation having a fixed other polarity for each of the plurality of geometrically shaped elements, the performance characteristics of the microwave waveguide is a second performance characteristic, and wherein the difference between the first and the second performance characteristics defines a first performance tolerance, the random variation from each of the known dimensions resulting in performance characteristics of the microwave waveguide having an actual performance tolerance substantially less than the first performance tolerance.

BRIEF DESCRIPTION OF THE DRAWINGS

Reference will now be made to the accompanying drawings, in which like reference numerals refer to like elements throughout.

FIG. 4(*c*) illustrates the different cross section profiles of the pin elements.

DETAILED DESCRIPTION OF THE ILLUSTRATED PREFERRED EMBODIMENT

Figure 1A:
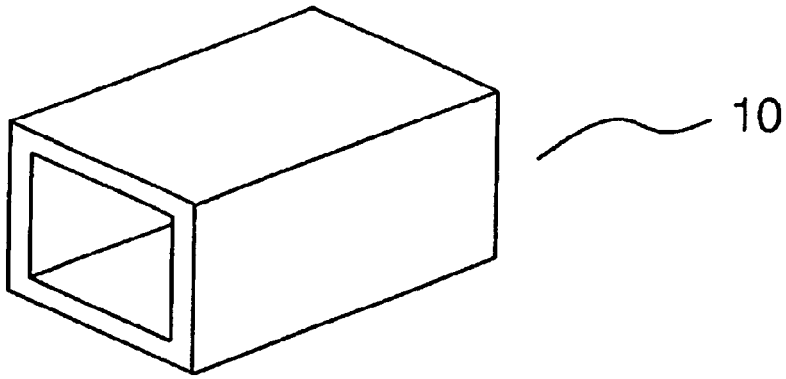
(Prior Art) Figure 1a
FIGS. 1(*a*) and 1(*b*) illustrate a prior art waveguide, FIG. 1(*a*) being a perspective view thereof and FIG. 1(*b*) being a side cross-sectional view of the prior art waveguide of FIG. 1(*a*).
Figure 1B:
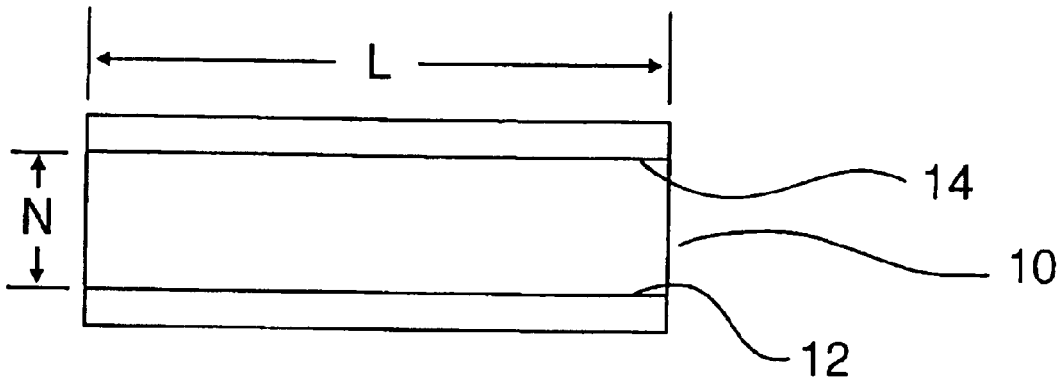
(Prior Art) Figure 1b

Referring to FIGS. 1(*a*) and 1(*b*), a prior art microwave waveguide cavity 10 is shown. The near (primary) field is determined according to a calculation based on the channel height n and the channel length l of the waveguide cavity 10. For this conventional waveguide, the near filed extends over a full length of the parallel sides 12 and 14 resulting in undesirable loss characteristics for the waveguide.

Figure 2:
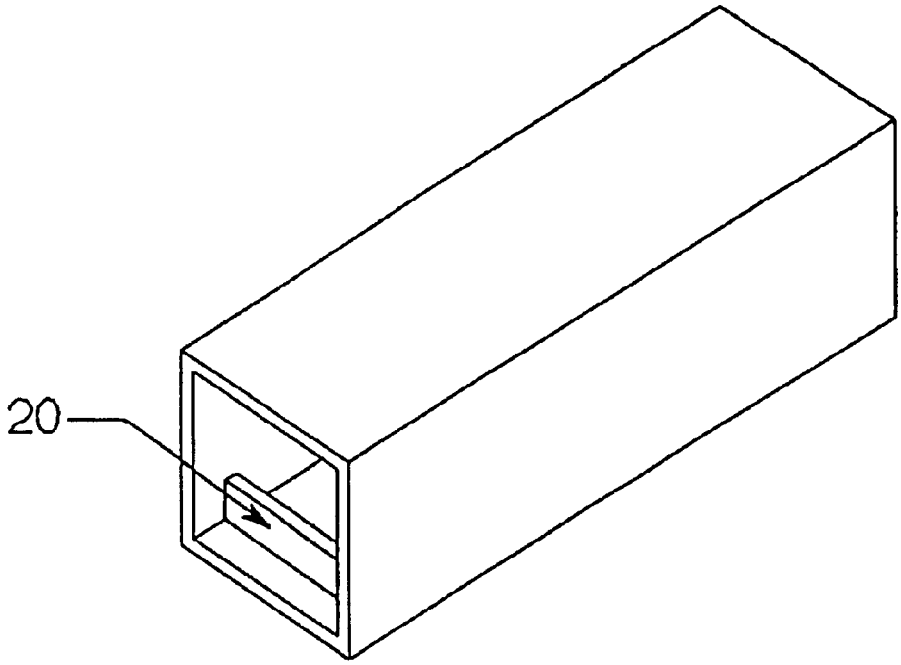
FIGS. 2(*a*) and 2(*b*) illustrate an exemplary waveguide in accordance with the present invention, FIG. 2(*a*) being a perspective view thereof and FIG. 2(*b*) being a side cross-sectional view of the waveguide of FIG. 2(*a*).
Figure 2:
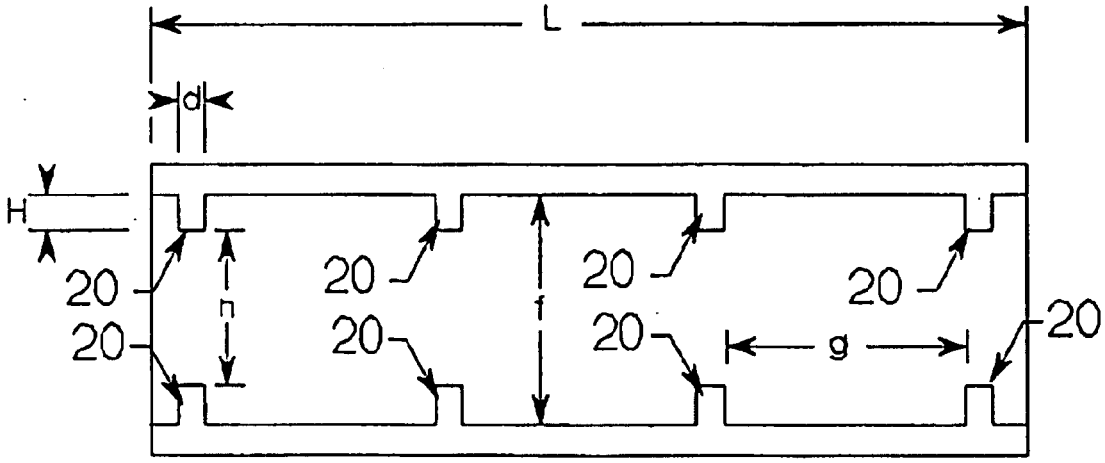

FIGS. 2(*a*) and 2(*b*) show a relatively simple waveguide in accordance with this invention in which a simple geometric bar-shaped element 20 of uniform height h is incorporated into the waveguide channel at spaced intervals along the top and/or bottom sides of the waveguide channel and the field response is determined as a result of the primary field associated with the distance between two adjacent elements 20. A sufficient primary (near) field must be produced in order to support the required, pre-determined microwave manipulation. For this embodiment the primary (near) field calculation is determined on the basis of the uninterrupted channel height n and the length L of the waveguide and the associated secondary (far) field calculation is determined on the basis of the greatest (interrupted) channel height f, the length d of the bar element (geometric shape) 20 and the distance g between adjacent bar elements (geometric shapes) 20.

Figure 3:
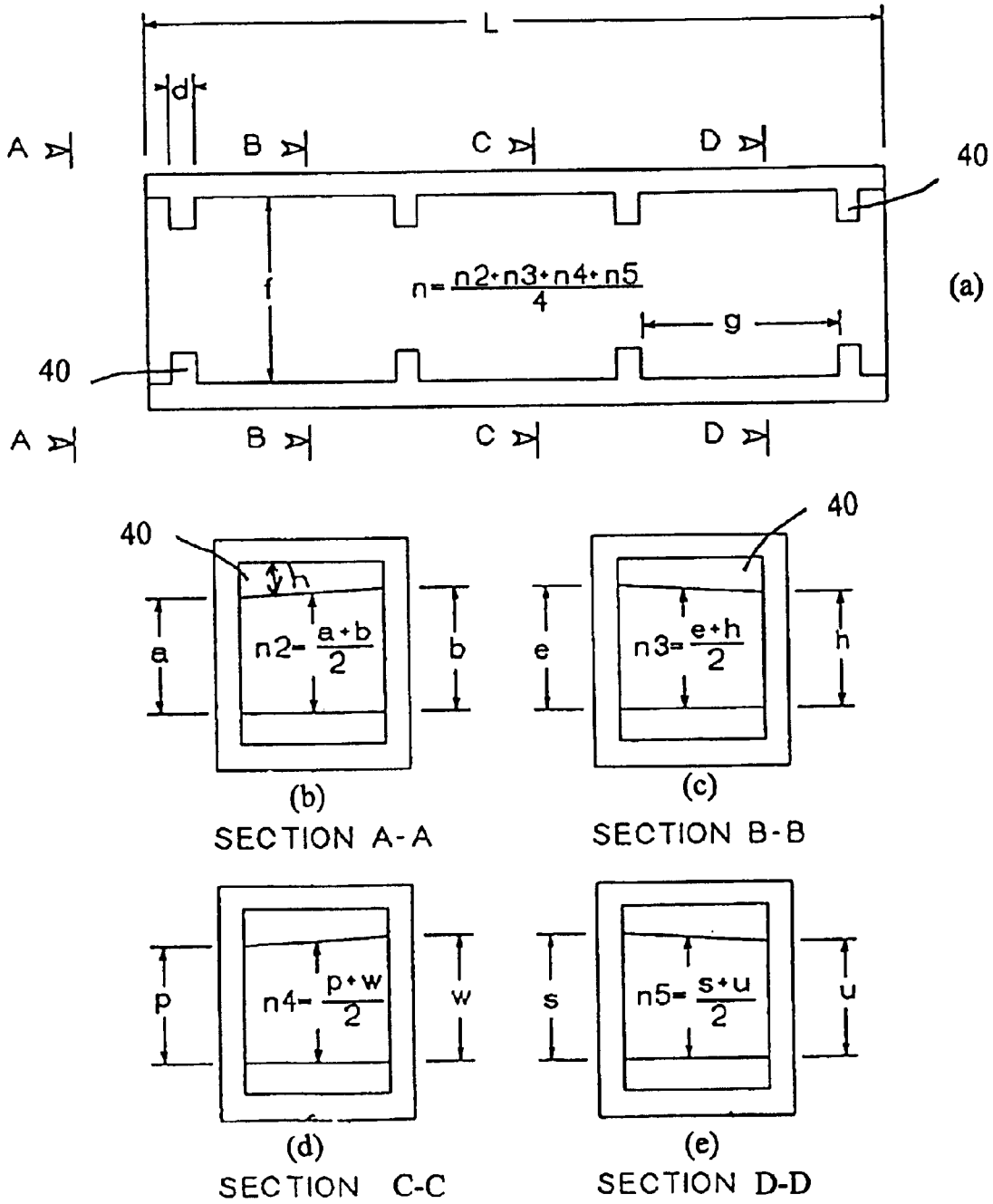
FIGS. 3(*a*)–(*e*) illustrate another exemplary waveguide in accordance with the present invention, FIG. 3(*a*) showing side cross-sectional view of the waveguide and FIGS. 3(*b*)–(*e*) showing front cross-sectional views taken at A—A, B—B, C—C, and D—D, respectively.

FIGS. 3(*a*)–(*e*) show a more complex waveguide in accordance with this invention in which a bar-shaped element 40 is incorporated into the waveguide channel at space intervals along the top and bottom sides of the waveguide channel and the height h of one set of these (being the upper elements in these figures) varies across its width as shown by FIG. 3(*a*), with adjacent bar elements having a similar varying height but wherein the height increases/decreases in alternating directions in each adjacent bar element as illustrated by FIGS. 3(*b*)–(*e*). This varies the near field and field response is determined as a result of an averaging of the primary field and associated fields whereby there is no longer any need that these elements be located precisely within the waveguide.

Figure 4:
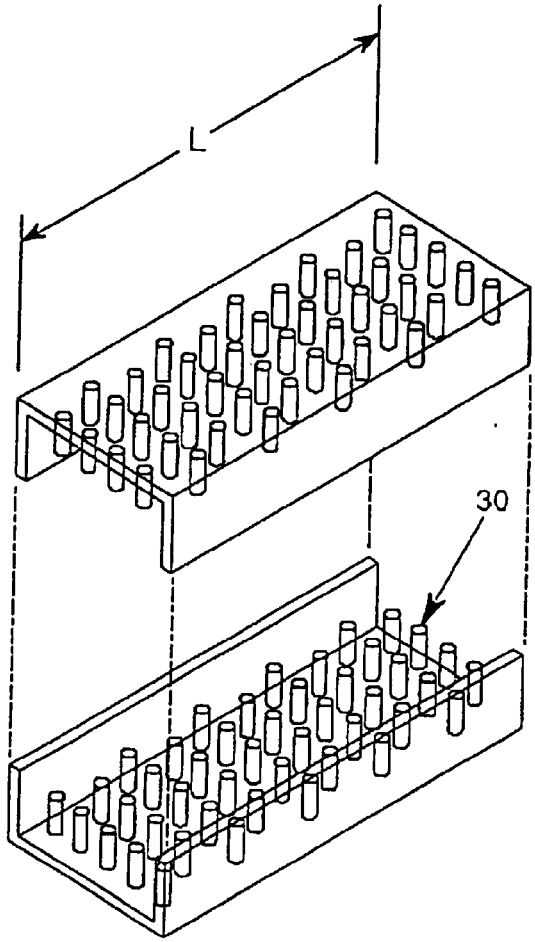
FIGS. 4(*a*) and 4(*b*) illustrates another exemplary waveguide in accordance with the present invention, FIG. 4(*a*) being a fragmented perspective view thereof (showing separated top and bottom halves one over the other) and FIG. 4(*b*) being a side cross-sectional view of the waveguide of FIG. 4(*a*) (but with the top and bottom halves joined together).
Figure 4:
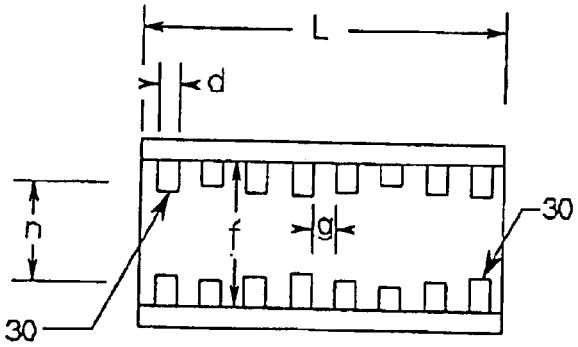
Figure 4:
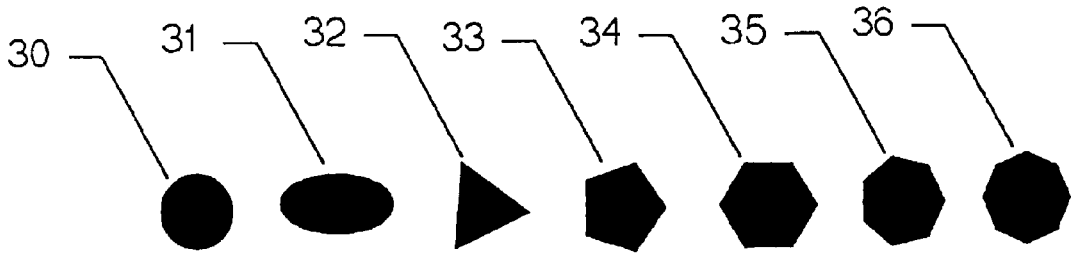

Referring to FIGS. 4(*a*) and 4(*b*), it is evident that in manufacturing each pin 30 will have a slightly varied height due to manufacturing tolerances, these varied heights should, theoretically, average to the design specified height given a sufficiently large number of pins 30. A field of microwave radiation traversing the waveguide of FIG. 4(*b*) is affected by the pins 30 in accordance with an averaging of their affects as is well understood in the filed of microwave design. Thus, the effect resulting from the field passing over each pin are all included in the final overall effect. This final overall effect is a result of a combination of the heights of all the pins in some fashion. The combination is most closely described as an averaging effect.

In prior art designs, as shown in FIG. 1(*a*), the goal was to achieve exacting dimensions on each and every part of the microwave waveguide to ensure accurate cavity dimensions. It has now been found that these exacting dimensions are not completely necessary because an averaging approach such as that presented in FIG. 4(*b*) allows for a more exacting average value at a lower cost than is achievable when each part is to meet or exceed certain accuracy in dimension and placement.

The pins 30 are shown with a circular sectional geometry and are disposed in an irregular manner along the top and/or bottom sides of the waveguide channel. Because the pin arrangement is irregular and is dispersed in a somewhat random fashion field response averaging results. Because of the use of elements within the cavity, a loss reduction results as well. Of course, other advantages may also result. The field response averaging allows for supporting manufacturing tolerances far less stringent than those required for a simple cavity having no elements therein. Optionally as shown in FIG. 4 (*c*), different cross sections of the pin elements, such as circular, oval, triangular, or polygonal are used. Further optionally, a combination of pin cross sections is employable.

Also, pins and other forms of elements may optionally be combined within a same microwave waveguide cavity.

Figure 5:
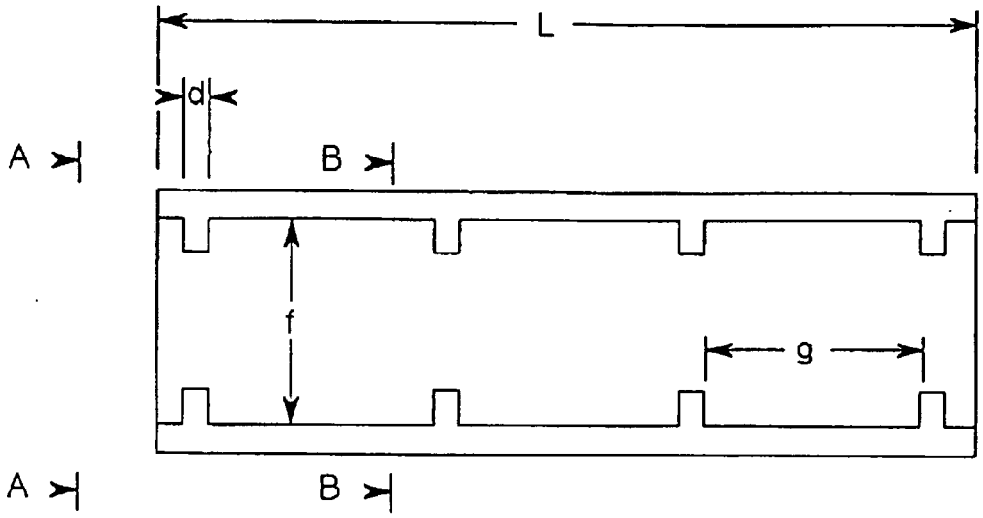
FIGS. 5(*a*)–(*c*) illustrate another exemplary waveguide in accordance with the present invention, FIG. 5(*a*) showing a side cross-sectional view of the waveguide and FIGS. 5(*b*) & (*c*) showing front cross-sectional views taken at sections A—A, B—B, respectively. The element shapes shown are typical, however, the shapes, combinations and locations of said elements are not limited to those illustrated.
Figure 5:
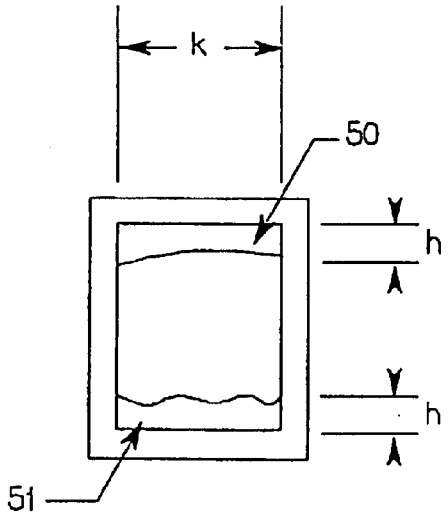
Figure 5:
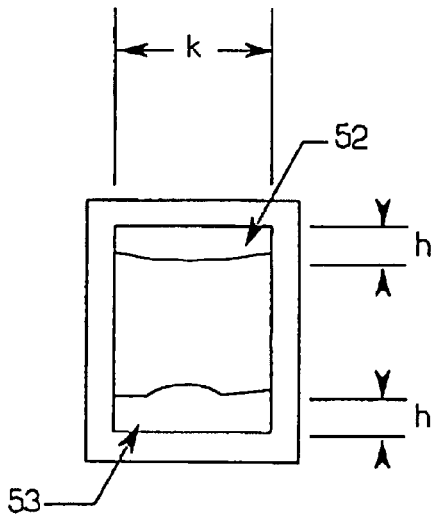

FIGS. 5(*a*)–(*d*) show a waveguide in accordance with this invention in which bar-shaped elements 50–53 or any combination thereof, are incorporated within the waveguide channel at spaced intervals along the top and/or bottom sides of the waveguide channel. As shown, the height h varies along the length k of the bar element. The bar elements 50–53 are shown in FIGS. 5(*b*) & (*c*). Optionally, the bar element varying in cross-section along its width or along both width and length is used.

Thus, due to the varied bar geometry, an averaging effect similar to that described with reference to FIG. 4 occurs and the near field and field response results from the averaging of the primary field and associated fields. Thus, there is no longer a requirement that the bar shaped elements be located and dimensioned precisely within the waveguide.

Figure 6:
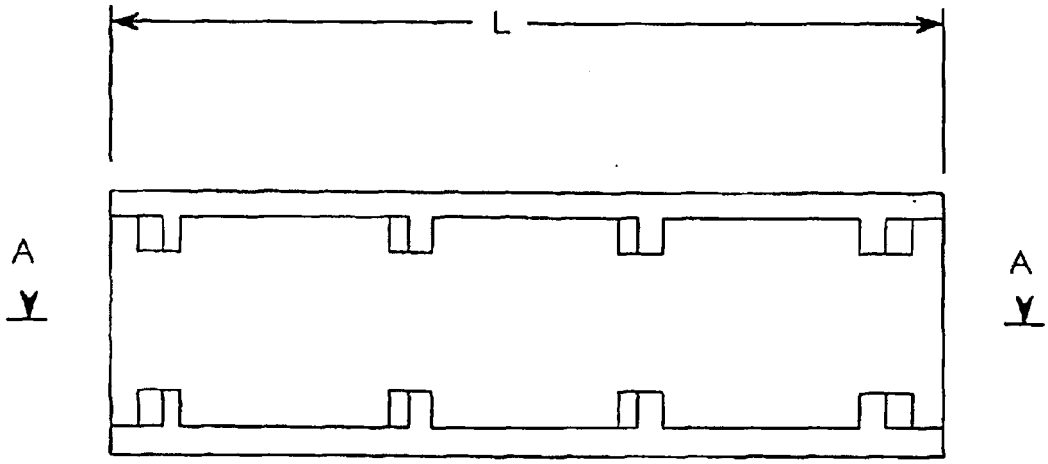
FIGS. 6(*a*) & (*b*) illustrate another exemplary waveguide in accordance with the present invention, FIG. 6(*a*) showing a side cross-sectional view of the waveguide and FIGS. 6(*b*) showing a plan cross-sectional view taken at section A—A. The element shapes shown are typical, however, the; shapes, combinations and locations of said elements are not limited to those illustrated.
Figure 6:
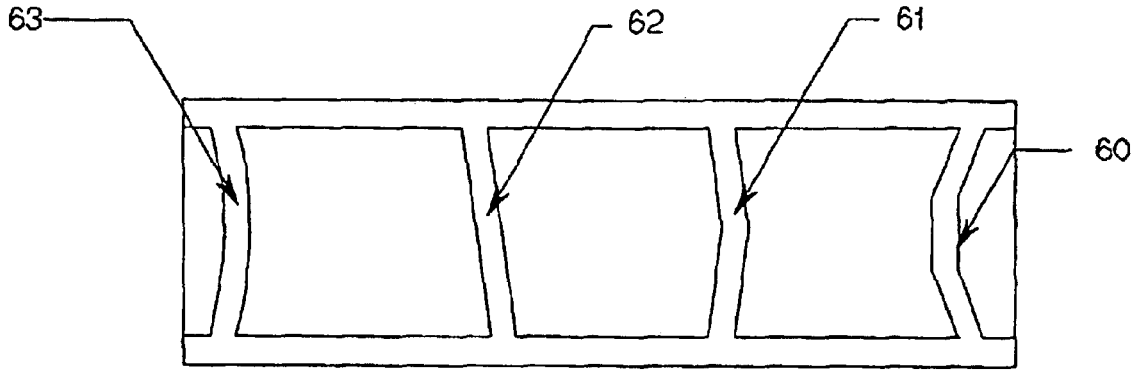

FIGS. 6(*a*) & 6(*b*) show a waveguide in accordance with this invention in which bar-shaped elements 60–63 are incorporated into the waveguide channel at spaced intervals along the top and/or bottom sides of the waveguide channel. As shown, the bars are not perpendicular to the waveguide channel (see section A—A in FIG. 6(*b*)). This varies the near field and field response as a result of an averaging of the primary field and associated fields. Because of the averaging effects, these elements need not be dimensioned and located precisely within the waveguide.

Figure 7:
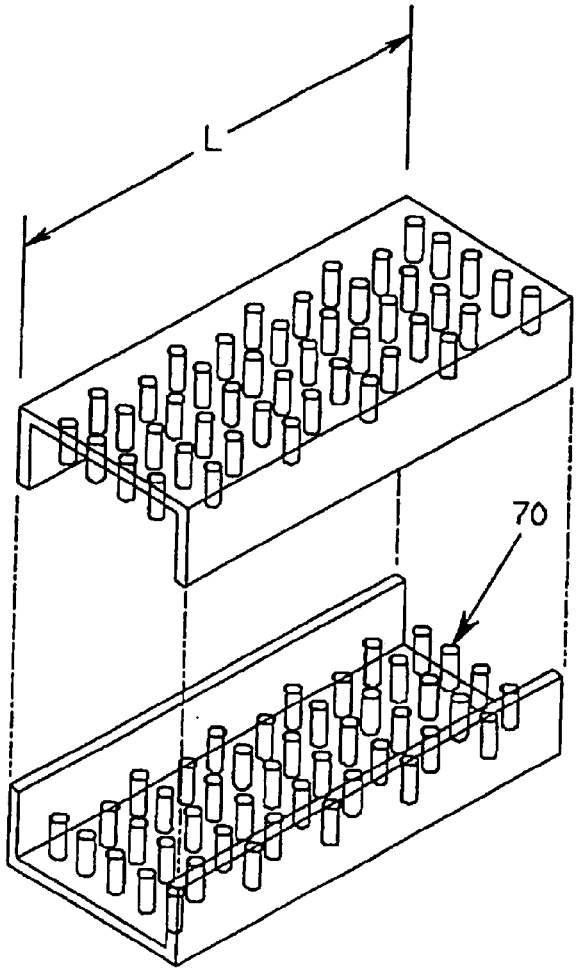
FIGS. 7(*a*) and 7(*b*) illustrates another exemplary waveguide in accordance with the present invention, FIG. 7(*a*) being a fragmented perspective view thereof (showing separated top and bottom halves one over the other) and FIG. 7(*b*) being a side cross-sectional view of the waveguide of FIG. 7(*a*) (but with the top and bottom halves joined together), where h is the variable pin height.
Figure 7:
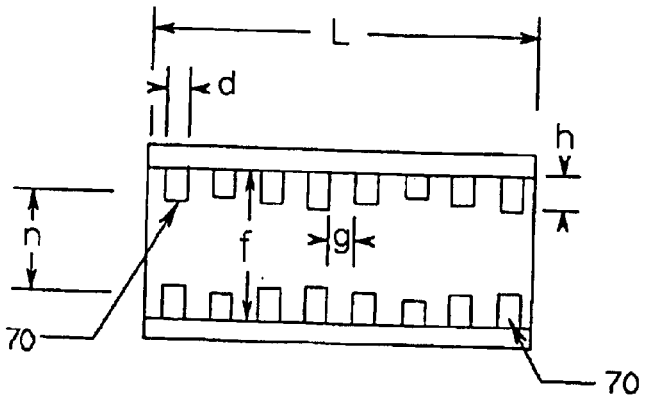

FIGS. 7(*a*) and 7(*b*) show a waveguide in accordance with the invention in which pin-shape elements 70, which vary in height h, are used as the geometrically-shaped elements and are located in an irregular manner along the top and/or bottom sides of the waveguide channel. Of course, optionally, the pin shaped elements are arranged in a more regular fashion or even in a completely regular fashion if so desired. Pin cross sections are optionally any shape including those shown in FIG. 4(*c*) and including any combination of those pin shaped elements.

Figure 8:
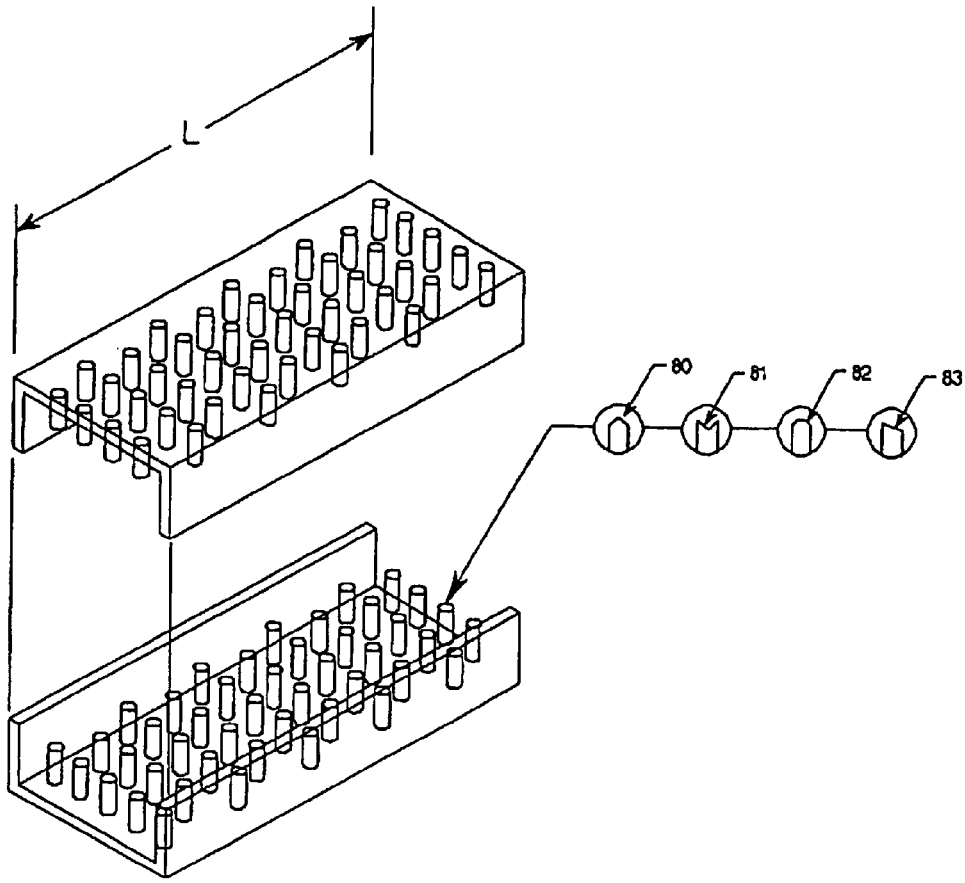
FIGS. 8(*a*) and 8(*b*) illustrates another exemplary waveguide in accordance with the present invention, FIG. 8(*a*) being a fragmented perspective view thereof (showing separated top and bottom halves one over the other) and FIG. 8(*b*) being a side cross-sectional view of the waveguide of FIG. 8(*a*) (but with the top and bottom halves joined together), The profile tip of the element shapes shown are typical, however, the; shapes, combinations and locations of said element profiled tips are not limited to those illustrated.
Figure 8:
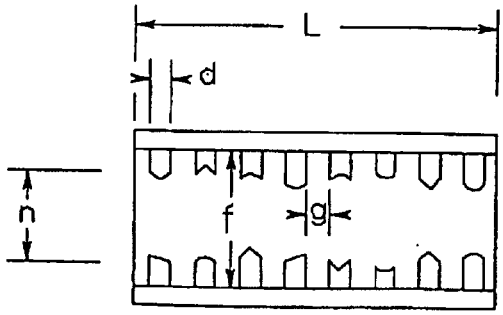

FIGS. 8(*a*) and 8(*b*) show a waveguide in accordance with the invention in which different profiled tipped pin-shaped elements 80–83 or a single tip profile, are used as the geometrically shaped elements. The elements are located in an irregular manner along the top and/or bottom sidewalls of the waveguide channel. This profiled tipped pin-shape waveguide configuration achieves loss reduction along with the field response averaging as described above. The use of tip profiling may also allow for increased fine tolerance averaging in some situations.

Figure 9:
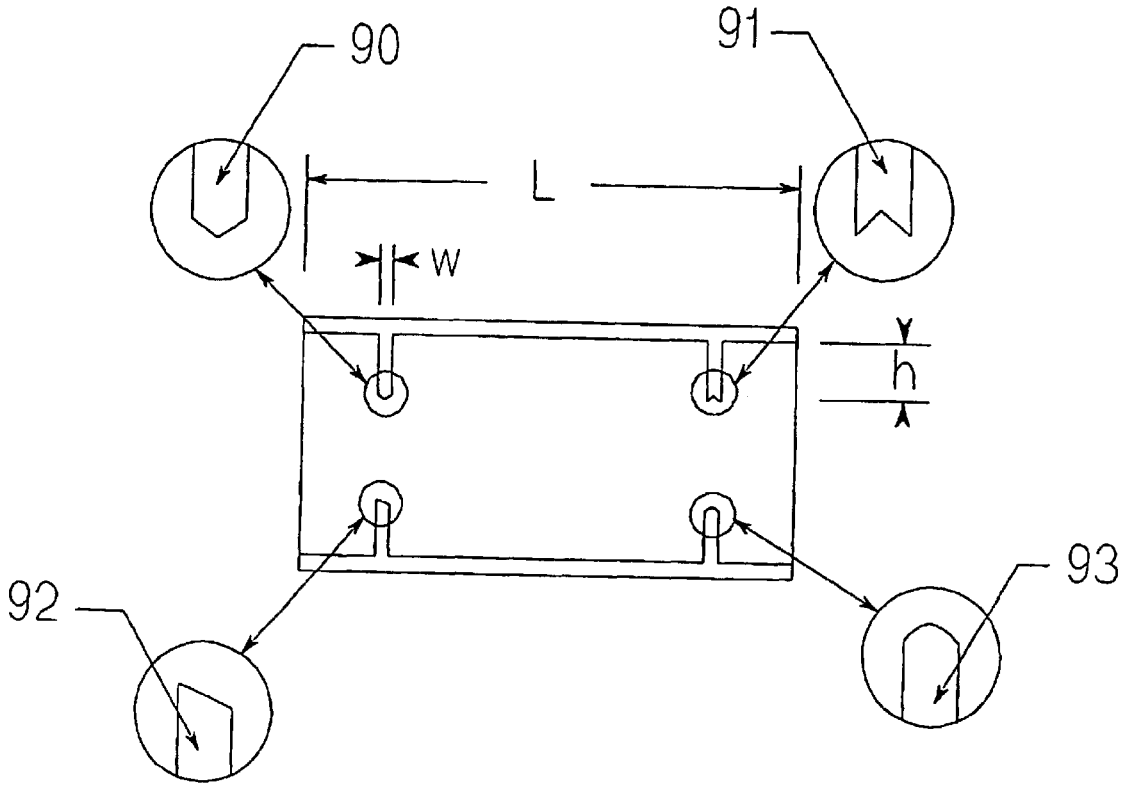
FIG. 9 illustrates another exemplary waveguide in accordance with the present invention, FIG. 9 showing a side cross-sectional view of the waveguide showing bar shaped elements which vary in height across the width of the said element. The height variation across the width of the bar elements shown are typical, however, the; shapes, combinations and locations of said elements are not limited to those illustrated.

FIG. 9 show a waveguide in accordance with this invention in which bar-shaped elements 90–93, are incorporated within the waveguide channel at spaced intervals along the top and/or bottom side walls of the waveguide channel. Optionally, a same element profile is provided for all four or any combination of the four profiles is used. The height h of an element varies across the width w of the element. This achieves the averaging described above to support the inventive advantages.

Though the invention is described with reference to a conductive cavity and conductive geometrically shaped elements, it is equally applicable to other microwave waveguide cavities, other resonating elements, and so forth. For example, the geometrically-shaped elements are optionally replaced by a dielectric element with metalisation thereon. Further optionally, the geometrically-shaped elements are optionally replaced by a carrier having patches printed thereon. Further optionally, the cavity is formed of a metal coated structure.

Figure 10:
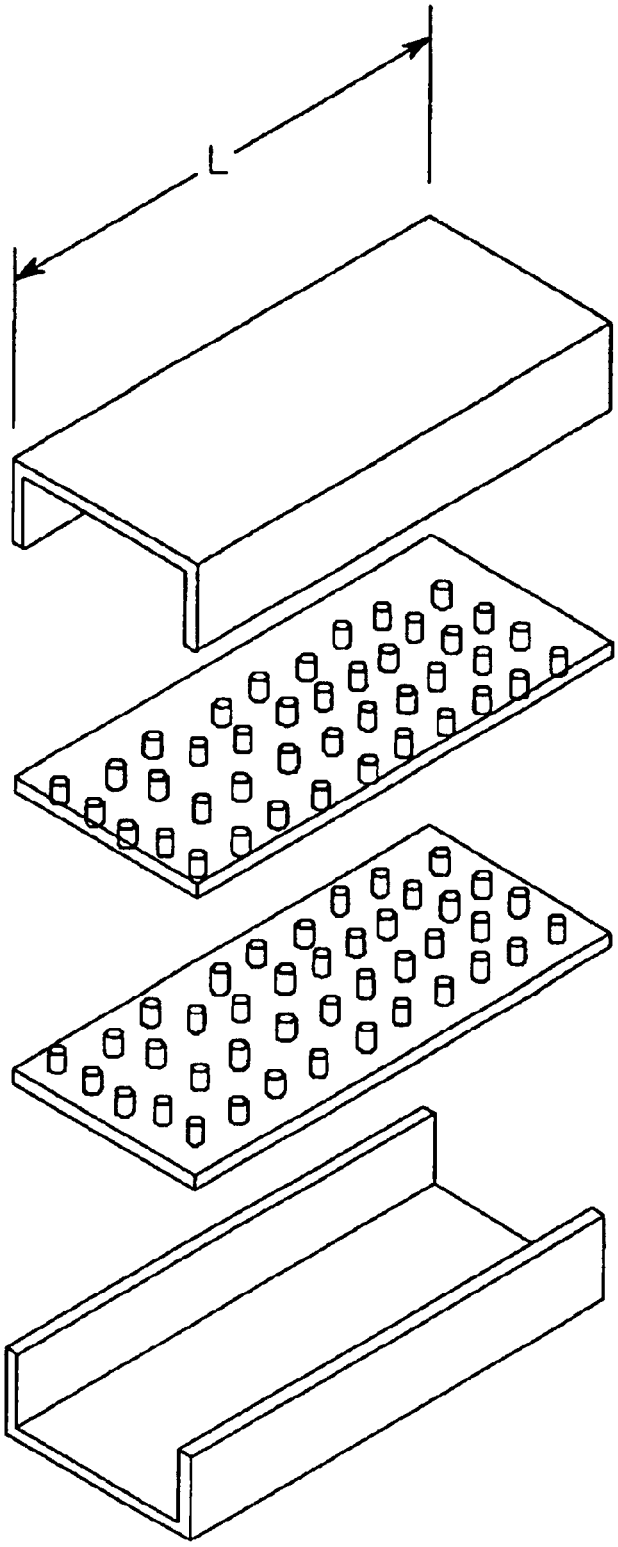
FIG. 10 illustrates another exemplary waveguide in accordance with the present invention, FIG. 10 being a fragmented perspective view thereof (showing separated top and bottom halves one over the other).

In FIG. 10, a high precision metal cavity is shown with an electromagnetically transparent insulating material disposed on an inside surface thereof. Onto this material is printed metalisation including vias for connecting the metalisation and the cavity. The metalisation so connected acts to shape a radiation field propagating within the cavity. Since the insulating material is, as shown, irregular in height, the averaging effect results as disclosed above.

Figure 11:
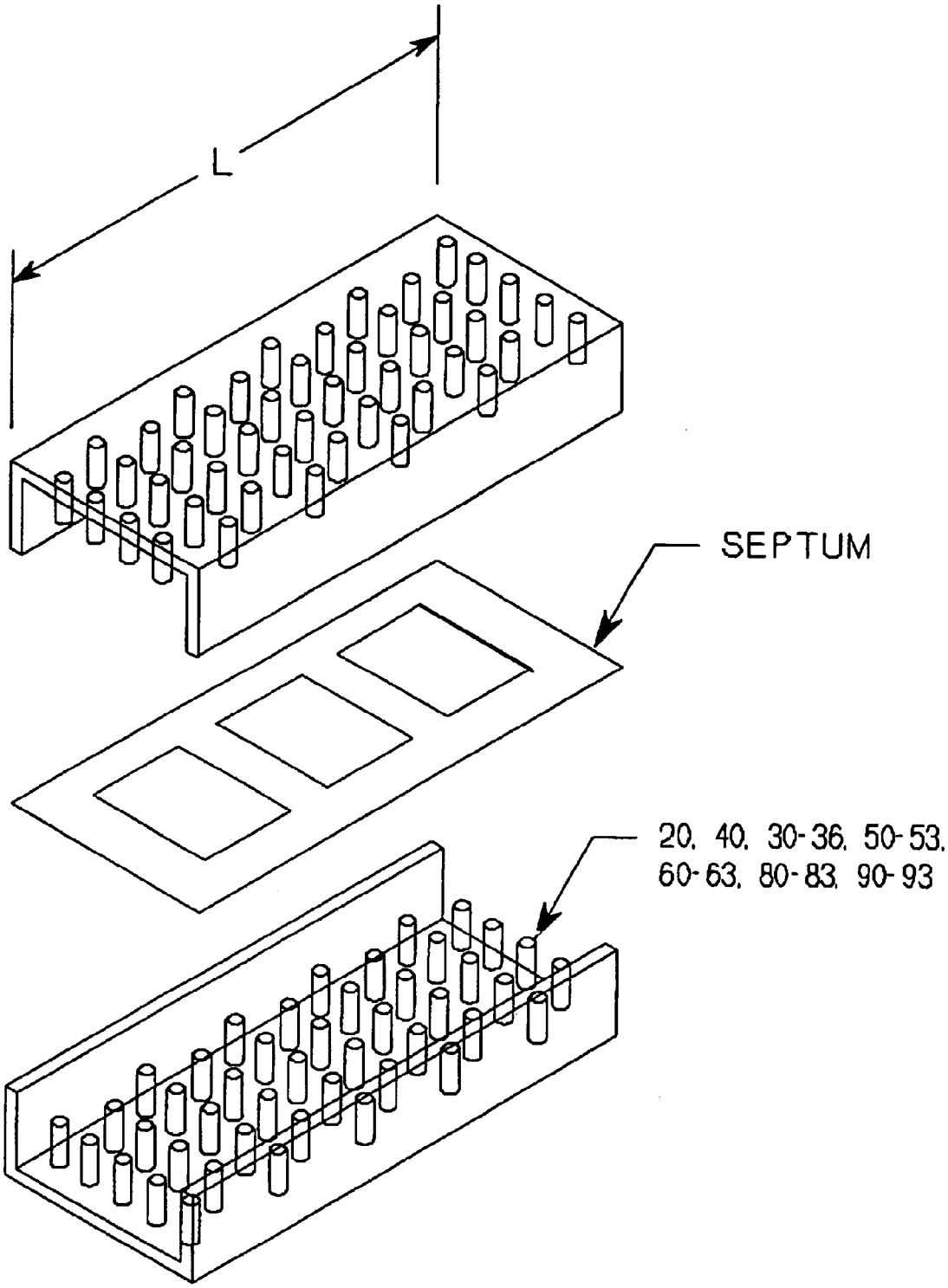
FIG. 11 illustrates another exemplary waveguide in accordance with the present invention, FIG. 11 being a fragmented perspective view thereof (showing separated top and bottom halves one over the other) with the slotted structure (Septum) present.

Referring to FIG. 11, an E-plane filter is shown. Here a slotted structure is disposed within the cavity along its longitudinal structure. The slots form resonant cavities. The inclusion of geometrically shaped elements within the cavity above the slotted structure results in an averaging effect between the slotted structure and the elements and, thereby incorporates the advantages of the present invention into the E-plane filter structure. Alternatively, the cavity is formed in two portions and the slotted structure is sandwiched therebetween. Further alternatively, geometrically shaped elements are positioned above and below the slotted structure. Further additionally, the geometrically shaped elements are in different section and size than those shown in FIG. 11 in accordance with geometrically shaped elements discussed hereinabove.

The foregoing benefits provided by this invention may be obtained at most microwave frequencies and are most substantial at higher frequencies.

It is to be understood that the particular embodiments described herein, by way of illustration, are not intended to limit the scope of the invention claimed by the inventor which is defined by the appended claims. In particular, it is to be understood that the invention is not limited to any particular element shapes and although the illustrated embodiments show the use of geometrically shaped elements along both the top and bottom sides of the microwave component it may be satisfactory, depending upon the application, to position such elements along one side only.

What is claimed is:

1. A microwave component configured for satisfying predetermined performance characteristics and comprising:

a channel;

a plurality of geometrically-shaped elements having varying dimensions and producing a field response, positioned in spaced relationship within said channel, wherein the number, dimensions and spacing of said elements determine said performance characteristics where said elements are pin shaped, with a profiled tip and are arranged irregularly in said channel.

2. A microwave component for operating within a predetermined performance tolerance comprising:

a waveguide channel;

a plurality of geometrically-shaped elements producing a field response and having known dimensions within a tolerance, the tolerance defining a random variation from each of the known dimensions and positioned within the channel in spaced relationship one to another, wherein the number, dimensions and spacing of said elements determine performance characteristics of the microwave waveguide, characterized in that if the random variation from each of the known dimensions is a fixed same maximum variation having a fixed same polarity for each of the plurality of geometrically shaped elements, the performance characteristics of the microwave waveguide is a first performance characteristic and if the random variation from each of the known dimensions is a fixed same maximum variation having a fixed other polarity for each of the plurality of geometrically shaped elements, the performance characteristics of the microwave waveguide is a second performance characteristic, and wherein the difference between the first and the second performance characteristics defines a first performance tolerance, the random variation from each of the known dimensions resulting in performance characteristics of the microwave waveguide having an actual performance tolerance substantially less than the first performance tolerance, and wherein the actual performance tolerance is within the predetermined performance tolerance.

3. A microwave component according to claim 2, wherein some of the plurality of geometrically-shaped elements are bar shaped.

4. A microwave component, according to claim 3, wherein the microwave component is for satisfying predetermined performance characteristics.

5. A microwave component, according to claim 4, wherein all of the plurality of geometrically-shaped elements are bar shaped.

6. A microwave component according to claim 5, wherein some of the plurality of geometrically-shaped elements are other than perpendicular to the channel length.

7. A microwave component according to claim 6, wherein some of the plurality of geometrically-shaped elements are positioned transverse said channel.

8. A microwave component according to claim 5, wherein a bar-shaped element of the plurality of geometrically-shaped elements varies in height along its length.

9. A microwave component according to claim 8, wherein the bar-shaped element is other than perpendicular to the channel length.

10. A microwave component according to claim 9, wherein the bar-shaped element is positioned transverse said channel.

11. A microwave component according to claim 5, wherein a bar-shaped element of the plurality of geometrically-shaped elements varies in height across the width of said element.

12. A microwave component according to claim 11, wherein the bar-shaped element is other than perpendicular to the channel length.

13. A microwave component according to claim 12, wherein the bar-shaped element is positioned transverse said channel.

14. A microwave component, according to claim 3, wherein all of the plurality of geometrically-shaped elements are bar shaped.

15. A microwave component according to claim 14, wherein a bar-shaped element of the plurality of geometrically-shaped elements is other than perpendicular to the channel length.

16. A microwave component according to claim 15, wherein the bar-shaped element is positioned transverse said channel.

17. A microwave component according to claim 14, wherein a bar-shaped element of the plurality of geometrically shaped elements varies in height along its length.

18. A microwave component according to claim 17, wherein the bar-shaped element is disposed other than perpendicular to the channel length.

19. A microwave component according to claim 18, wherein the bar-shaped element is disposed transverse said channel.

20. A microwave component according to claim 14, wherein a bar-shaped element of the plurality of geometrically shaped elements varies in height across the width of said element.

21. A microwave component according to claim 20, wherein the bar-shaped element is other than perpendicular to the channel length.

22. A microwave component according to claim 21, wherein the bar-shaped element is positioned transverse said channel.

23. A microwave component according to claim 2, wherein at least one of the plurality of geometrically-shaped elements is a pin shaped element.

24. A microwave component according to claim 23, wherein the pin-shaped element has a section about its longitudinal axis, the section varying proximate a tip thereof, the tip located proximate an end of the pin-shaped element opposite a wall of the waveguide cavity.

25. A microwave component according to claim 23, wherein the pin-shaped elements has a variation in dimensions thereof, the variation other than accounted for based on manufacturing tolerances of the pin-shaped elements.

26. A microwave component according to claim 2, wherein the plurality of geometrically-shaped elements comprises a plurality of pin shaped elements.

27. A microwave component according to claim 26, wherein the pin-shaped elements are arranged other than regularly spaced in the waveguide channel.

28. A microwave component, according to claim 27, wherein the microwave component is for satisfying predetermined performance characteristics.

29. A microwave component according to claim 28, wherein the plurality of pin-shaped elements are circular in section.

30. A microwave component according to claim 28, wherein the plurality of pin-shaped elements are oval in section.

31. A microwave component according to claim 28, wherein the plurality of pin-shaped elements are polygon in section.

32. A microwave component according to claim 28, wherein the plurality of pin-shaped elements are triangular in section.

33. A microwave component according to claim 2, wherein the plurality of geometrically-shaped elements includes a plurality of different geometrically shaped elements some of which have different geometric cross sections attributable to other than effects of manufacturing tolerances.

34. A microwave component for operating within a predetermined performance tolerance comprising:

a waveguide channel having a length;

at least a geometrically-shaped element producing a field response and having known dimensions within a tolerance, the tolerance defining a random variation from each of the known dimensions and positioned within the channel in spaced relationship one to another, wherein the number, dimensions and spacing of the at least a geometrically-shaped element determine performance characteristics of the microwave waveguide, characterized in that if the random variation from each of the known dimensions along an axis defined relative to a longitudinal axis of the element and in a direction defined from a centre of the element is a fixed same maximum variation for each of the at least a geometrically shaped element, the performance characteristics of the microwave waveguide is a first performance characteristic and if the random variation from each of the known dimensions along an axis defined relative to a longitudinal axis of the element and in a direction defined from a centre of the element is a fixed same minimum variation for each of the at least a geometrically shaped element, the performance characteristics of the microwave waveguide is a second performance characteristic, and wherein the difference between the first and the second performance characteristics defines a first performance tolerance, the random variation from each of the known dimensions resulting in performance characteristics of the microwave waveguide having an actual performance tolerance substantially less than the first performance tolerance and wherein the actual performance tolerance is within the predetermined performance tolerance.

35. A method for making a waveguide component comprising:

providing a channel;

providing plurality of geometrically-shaped elements having varying dimensions and producing a field response; and, providing in spaced relationship within said channel a slotted structure, wherein the number, dimensions and spacing of said elements and said slotted structure determine said performance characteristics, and said elements are pin shaped, with a profiled tip and are arranged irregularly in said channel.

* * * * *